US005572919A

United States Patent [19]

Ishizaki

[11] Patent Number: 5,572,919

[45] Date of Patent: Nov. 12, 1996

[54] APPARATUS FOR CONTROLLING PRESSURE IN A CYLINDER CHAMBER OF A HYDRAULIC PUMP-MOTOR

[75] Inventor: Naoki Ishizaki, Kanagawa, Japan

[73] Assignee: Kabushiki Kaisha Komatsu Seisakusho, Tokyo, Japan

[21] Appl. No.: 495,646

[22] PCT Filed: Dec. 22, 1993

[86] PCT No.: PCT/JP93/01862

§ 371 Date: Jun. 16, 1995

§ 102(e) Date: Jun. 16, 1995

[87] PCT Pub. No.: WO94/15097

PCT Pub. Date: Jul. 7, 1994

[30] Foreign Application Priority Data

Dec. 22, 1992 [JP] Japan ..... 4-87894

[51] Int. Cl.[6] ..... F04B 1/26

[52] U.S. Cl. ..... 91/499; 417/270; 417/296; 417/440; 417/522

[58] Field of Search ..... 417/270, 296, 417/297, 440, 505, 522; 91/499

[56] References Cited

U.S. PATENT DOCUMENTS

| | | | |
|---|---|---|---|
| 3,200,761 | 8/1965 | Firth et al. | 417/270 |
| 3,699,845 | 10/1972 | Ifield | 91/6.5 |
| 5,032,061 | 7/1991 | Porel | 417/297 |

FOREIGN PATENT DOCUMENTS

| | | |
|---|---|---|
| 56-6080 | 1/1981 | Japan . |
| 59-5778 | 1/1984 | Japan . |
| 64-13274 | 1/1989 | Japan . |
| 1-203666 | 8/1989 | Japan . |
| 2-238179 | 9/1990 | Japan . |

OTHER PUBLICATIONS

Kumamoto et al., "Research on Reduction of Pulsating Flow of Swash–Plate Axial Piston Pump", Hydraulics and Pneumatics Lecture Meeting, May 25–26, 1992, pp. 113–116.

*Primary Examiner*—Charles G. Freay
*Attorney, Agent, or Firm*—Wenderoth, Lind & Ponack

[57] ABSTRACT

An apparatus controls a pressure in a cylinder chamber of a hydraulic pump-motor. The cylinder chamber is formed by fitting a piston in a cylinder bore of a rotatable cylinder block, and the cylinder block is rotated so that ports going to the cylinder chambers are alternatively opened to a high pressure port and a lower pressure port that are both formed in a valve plate. The apparatus includes a first switching port formed at a top dead point side of the valve plate, the first switching port being communicated with a tank through a first open-close valve. A second switching port is formed at a bottom dead point of the valve plate, the second switching port being communicated with the high pressure port through a second open-close valve. A rotational speed detector detects a rotational speed of the cylinder block, a pressure detector detects a maximum pressure in the cylinder chamber and a control device controls opening and closing timings and opening magnitude of the first and second open-close valves in response to the rotational speed and the maximum pressure.

4 Claims, 3 Drawing Sheets

APPARATUS FOR CONTROLLING PRESSURE IN A CYLINDER CHAMBER OF A HYDRAULIC PUMP-MOTOR

TECHNICAL FIELD

The present invention relates to an apparatus for controlling pressure in a cylinder chamber of a hydraulic pump-motor.

BACKGROUND ART

As shown in FIG. 1, there is known a piston-type hydraulic pump-motor in which a cylinder block 3 secured to a shaft 2 is disposed inside a casing 1 to be rotatable, plurality of cylinder chambers 6 are formed into which pistons 5 are respectively fitted in a plurality of cylinder bores 4 of the cylinder block 3. The respective pistons 5 are disposed to be slidable in respective axial directions thereof in accordance with the rotation of the cylinder block 3 through slidable abutment of outer end portions of the pistons 5 against a swash plate 8 through piston shoes 7. And as shown in FIG. 2, the cylinder chambers 6 are communicated with high and low pressure ports 10 and 11 formed in a valve plate 9 so as to alternately at every 180° rotation.

In such a hydraulic pump-motor, as shown in FIG. 2, ports 12 open to the cylinder chambers 6 alternately communicated with the high pressure ports 10 and the low pressure port 11 at top and bottom dead points of the valve plate 9 to thereby switch the operation "from drain to suction" and "from suction to drain".

Fine grooves 10*a* and 11*a* are formed with the high and low pressure ports 10 and 11 so as not to cause a rapid pressure change at the time of this switching operation.

That is, if the port 12 is suddenly communicated with the high or low pressure port 10 or 11, the pressure in the cylinder chamber 6 rapidly changes, thus causing hydraulic pressure pulsation or large noise. In order to prevent the pressure in the cylinder chamber 6 from rapidly changing, the fine grooves 10*a* and 11*a* are formed with the high and low pressure ports 10 and 11 so that the ports 12 are gradually open thereto through the fine grooves 10*a* and 11*a*.

However, since the shapes and sizes of the fine grooves 10*a* and 11*a* are made constant and the valve plate 9 is not moved, the port 12 always assumes a constant open position. Accordingly, it is difficult to always achieve most suitable operational characteristics at the time of changing the rotating speed of the cylinder block 3 or the maximum pressure in the cylinder chamber 6 at which the hydraulic pressure pulsation or noise will be caused.

SUMMARY OF THE INVENTION

The present invention aims to provide an apparatus for controlling pressure in a cylinder chamber of a hydraulic pump-motor that is capable of solving the problems described above.

Thus, an object of the present invention is to provide an apparatus for controlling pressure in a cylinder chamber that is capable of always achieving the most suitable operational characteristics by opening or closing switching ports in response to a rotational speed or a maximum pressure in a cylinder chamber to thereby prevent the pressure in the cylinder chamber from rapidly changing, thus preventing hydraulic pressure pulsation and noise from being caused.

The apparatus for controlling a pressure in the cylinder chamber according to the present invention was conceived in consideration of the above matters, and in order to achieve the above and other objects, there is provided, in one aspect, an apparatus for controlling a pressure in a cylinder chamber of a hydraulic pump-motor in which a cylinder chamber is formed by fitting a piston in a cylinder bore that is formed to in a rotatable cylinder block. The cylinder block is rotated so that ports to the cylinder chambers are alternately opened to a high pressure port and a low pressure port, both parts being formed in a valve plate. The apparatus being has a first switching port formed at a top dead point side of the valve plate. The first switching port being is communicated with a tank through a first open-close valve. A second switching port is formed at a bottom dead point of the valve plate, and the second switching port is communicated with the high pressure port through a second open-close valve and comprises a rotational speed detection means for detecting a rotational speed of the cylinder block, a pressure detection means for detecting a maximum pressure in the cylinder chamber and a control means for respectively controlling the opening and closing timings and opening magnitude of the first and second open-close valves in response to the rotational speed and the maximum pressure.

According to this structure, since the opening and closing timings of the first and second open-close valves can be controlled in response to the rotational speed of the cylinder block and the opening magnitude of the first and second open-close valves can be also controlled by the maximum pressure in the cylinder chamber, the opening and closing timings of the first and second switching ports, the drain amount from the cylinder chamber and the supply amount to the cylinder chamber can be controlled. Thus the most suitable operational characteristics can always be achieved, preventing the pressure in the cylinder chamber from rapidly changing and hence reducing the hydraulic pressure pulsation and noise.

In a preferred example, the first and second open-close valves are opened or closed by electrostrictive elements, the rotational speed detection means is a rotation speed sensor, the pressure detection means is a pressure detection sensor, and the control means is a controller for controlling current conduction to the electrostrictive elements in response to the maximum pressure in the cylinder chamber detected by the pressure detection sensor and controlling current conduction timings to the electrostrictive elements in response to the rotational speed of the cylinder block detected by the rotation speed sensor.

BRIEF DESCRIPTION OF THE DRAWINGS

The present invention will be made more understandable through the following detailed disclosure and the accompanying drawings representing an embodiment of the present invention. Further, it is to be noted that the embodiment illustrated in the drawings does not specify the present invention and is for easy explanation and understanding of the invention.

DETAILED DESCRIPTION OF THE PREFERRED EMBODIMENT

Hereunder, an apparatus for controlling a pressure in a cylinder chamber of a hydraulic pump-motor according to one preferred embodiment of the present invention will be described with reference to FIGS. 3 to 5.

Figure 1:
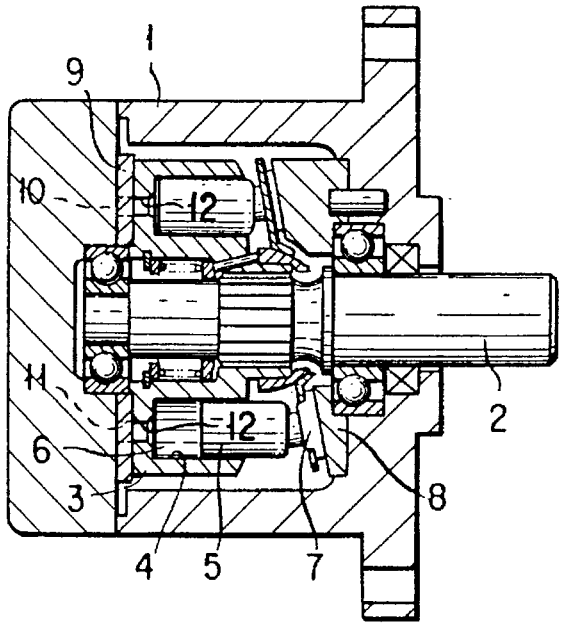
FIG. 1 PRIOR ART
FIG. 1 is a schematic sectional view of a hydraulic pump-motor.
Figure 2:
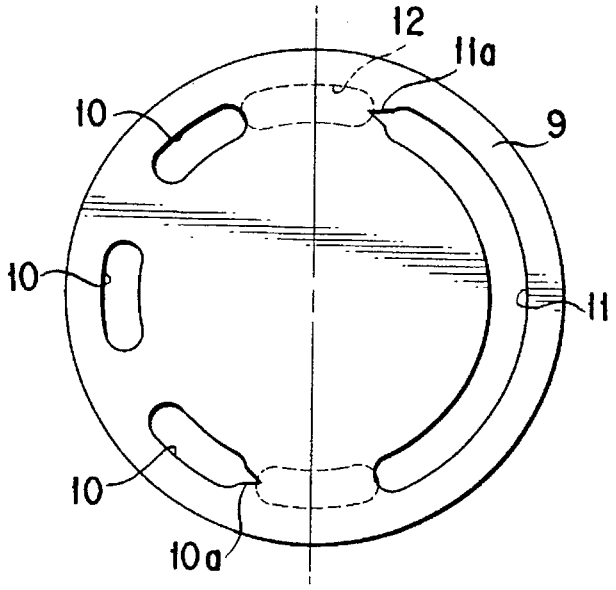
FIG. 2 PRIOR ART
FIG. 2 is a front view of a valve plate of the hydraulic pump-motor of FIG. 1.
Figure 3:
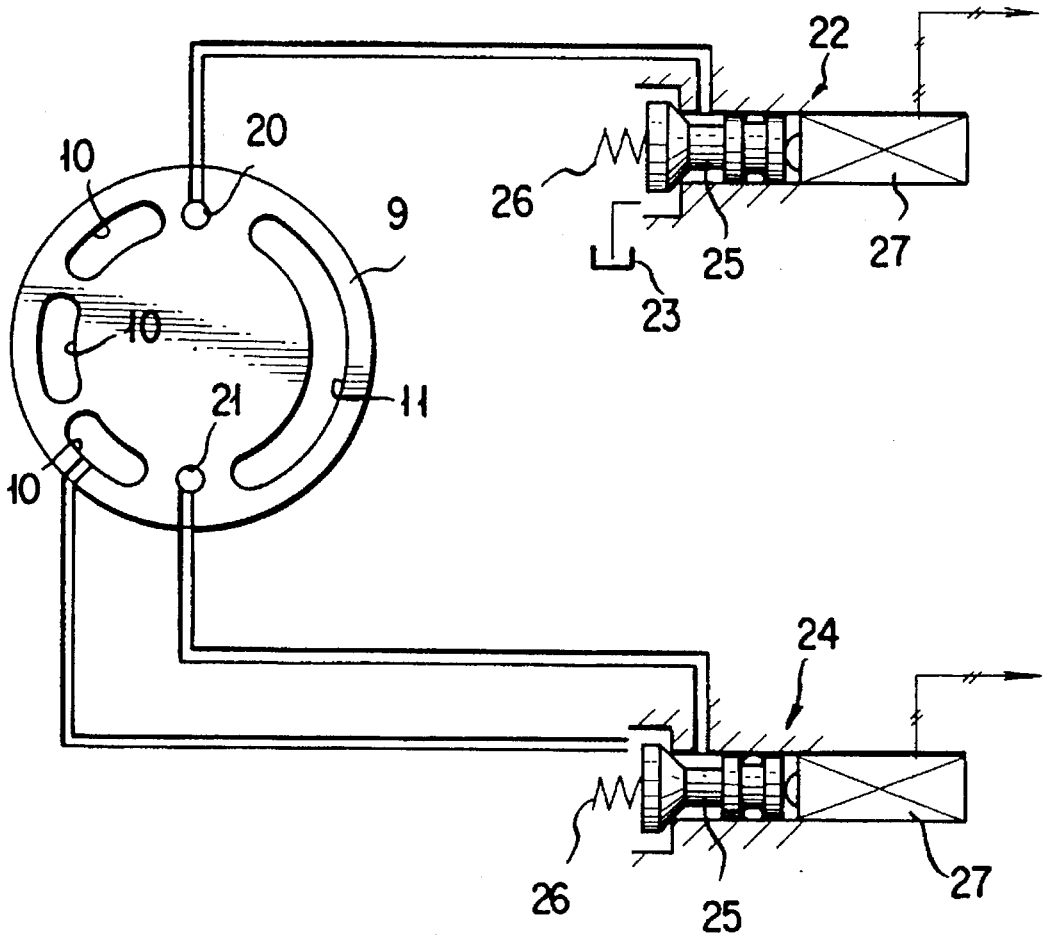
FIG. 3 is a view showing a structure of one embodiment of an apparatus for controlling a pressure in a cylinder chamber of a hydraulic pump-motor according to the present invention.
Figure 4:
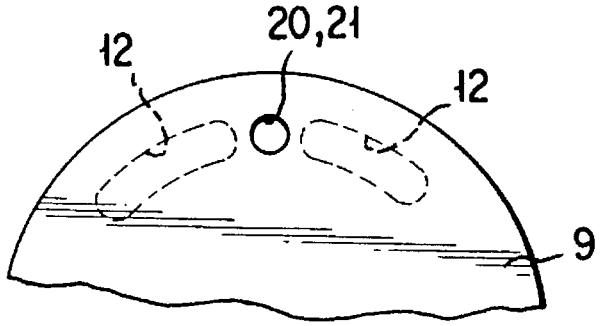
FIG. 4 is a partial enlarged view showing a switching port of the above-described embodiment of FIG. 3.

As shown in FIG. 3, first and second switching ports 20 and 21 are formed in a valve plate 9 on the top and bottom dead point sides, respectively. The first and second switching ports 20 and 21 each has a diameter smaller than the distance between ports 12 and 12 that go to cylinder chambers 6, as shown in FIG. 4.

The first switching port 20 is communicated with a tank 23 through a first open-close valve 22 and the second switching port 21 is communicated with a high pressure port 10 through a second open-close valve 24.

The first and second open-close valves 22 and 24 are each of an electromagnetic open-close type structure in which a valve 25 is held at its closed position by means of a spring 26 and is pushed to its opened position by means of an electrostrictive element 27. According to this structure, a large thrust force and a high degree of responsiveness can be achieved by using the electrostrictive element 27, and the opening area of the valve can be increased or decreased in response to amount of electrical current conduction to the electrostrictive element 27.

Figure 5:
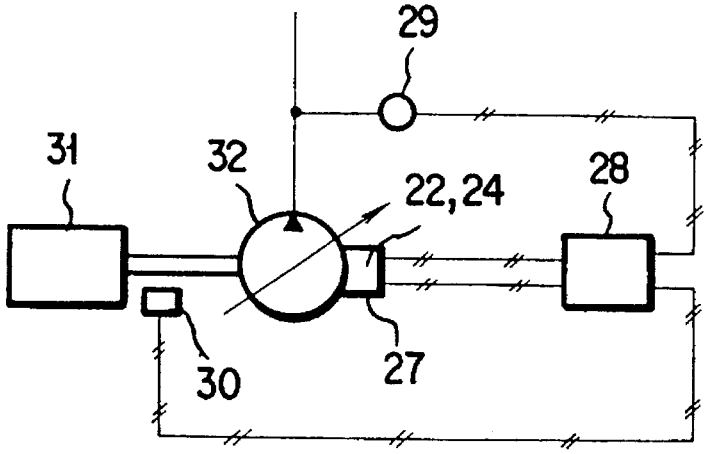
FIG. 5 is a control circuit diagram of the above-described embodiment of FIG. 3.

The electrical current conduction to each of the electrostrictive elements 27 is controlled by a controller 28 as shown in FIG. 5. To the controller 28, drain pressure detected by a pressure sensor 29, that is, the maximum pressure in the cylinder chamber 6, is inputted, and the rotational speed of an engine 31 detected by a rotation sensor 30, that is, the rotational speed of a hydraulic pump 32, is also inputted.

The embodiment of the structure described above will operate in the following manner.

During the movement of the port 12 to the side of the low pressure port 11 from the side of the high pressure port 10, when the port 12 reaches the first switching port 20, a current is conducted to the electrostrictive element 27 of the first open-close valve 22 to thereby open the valve 25 and hence to drain a highly pressurized oil in the cylinder chamber 6 to the tank 23. In this operation, the opening area of the first open-close valve 22 can be increased or decreased by controlling the electrical conduction amount to the electrostrictive element 27, thereby controlling the drain amount from the cylinder chamber 6.

Similarly, during the movement of the port 12 to the side of the high pressure port 10 from the side of the low pressure port 11, when the port 12 reaches the second switching port 21, a current is conducted to the electrostrictive element 27 of the second open-close valve 24 thereby to open the valve 25 and hence to supply a highly pressurized oil in the high pressure port 10 to the cylinder chamber 6. In this operation, the opening area of the second open-close valve 24 can be increased or decreased by controlling the electrical conduction amount to the electrostrictive element 27, thereby controlling the supply amount to the cylinder chamber 6.

Accordingly, the most suitable operational characteristics can always be achieved, even if the rotational speed of the cylinder block and the maximum pressure in the cylinder chamber 6 are changed, by controlling the electrical conduction timing to the electrostrictive elements 27 of the first and second open-close valves 22 and 24 via the rotational speed from the rotation sensor 30 and controlling the electrical conduction amount to the electrostrictive elements 27 via the pressure from the pressure sensor 29.

As described above, according to the present invention, the timing for opening or closing the first and second open-close valves 22 and 24 can be controlled by the rotational speed of the cylinder block and the opening degrees of the first and second open-close valves 22 and 24 can be also controlled by the maximum pressure in the cylinder chamber, so that the most suitable operational characteristics can be achieved from the first and second switching ports 20 and 21 in response to the rotational speed of the cylinder block and the maximum pressure in the cylinder chamber, thereby preventing the pressure in the cylinder chamber from rapidly changing and hence reducing the hydraulic pressure pulsation and noise from causing.

As described above, the apparatus for controlling the pressure in the cylinder chamber of the hydraulic pump-motor is extremely useful as an apparatus for controlling various types of hydraulic pump-motors.

Further, it is a self-evident to those skilled in the art that although the present invention has been described with reference to the exemplary embodiment, other various changes, deletions and additions can be made without departing from the subject and scope of the present invention with respect to the described embodiment. Accordingly, it is to be understood that the present invention is not limited to the described embodiment, and includes the scope prescribed by the elements recited in the claims and equivalents thereof.

I claim:

1. An apparatus for controlling pressure in a cylinder chamber of a hydraulic pump-motor, the hydraulic pump-motor comprising a rotatable cylinder block having a bore therein defining a cylinder chamber, a piston in the bore, a port communicating with the cylinder chamber and a valve plate having a high pressure port and a low pressure port, whereby the port communicating with the cylinder chamber is alternately opened to the high pressure port and the low pressure port upon rotation of the cylinder block, said apparatus comprising:

a first switching port formed at a top dead point side of the valve plate;

a tank communicating with said first switching port through a first open-close valve;

a second switching port formed at a bottom dead point side of the valve plate communicating with the high pressure port through a second open-close valve;

a rotational speed detecting means for detecting the rotational speed of the cylinder block;

a pressure detection means for detecting a maximum pressure in the cylinder chamber; and a control means for controlling timing of the opening and closing and opening magnitude of said first and second open-close valves in response to the rotational speed and the maximum pressure detected by said rotational speed detecting means and said pressure detection means.

2. The apparatus of claim 1, wherein:

said first and second open-close valves each comprises a valve element and an electrostrictive element for opening and closing said valve element;

said rotational speed detection means comprises a rotation speed sensor;

said pressure detection means comprises a pressure detection sensor; and said control means comprises a controller that controls current conduction to said electrostrictive elements in response to the maximum pressure in the cylinder chamber detected by said pressure detection sensor and controls the timing of current conduction to said electrostrictive elements in response to the rotational speed of the cylinder block detected by said rotation sensor.

3. An apparatus, comprising:

a hydraulic pump-motor comprising a rotatable cylinder block having a bore therein defining a cylinder chamber, a piston in the bore, a port communicating with said cylinder chamber and a valve plate having a high pressure port, a low pressure port, a top dead point side and a bottom dead point side, whereby said port communicating with said cylinder chamber is alternately opened to said high pressure port and said low pressure port upon rotation of said cylinder block;

a first switching port formed at said top dead point side of said valve plate;

a tank communicating with said first switching port through a first open-close valve;

a second switching port formed at said bottom dead point side of said valve plate communicating with the high pressure port through a second open-close valve;

a rotational speed detecting means for detecting the rotational speed of said cylinder block;

a pressure detection means for detecting a maximum pressure in said cylinder chamber; and a control means for controlling timing of the opening and closing and opening magnitude of said first and second open-close valves in response to the rotational speed and the maximum pressure detected by said rotational speed detecting means and said pressure detection means.

4. The apparatus of claim 3, wherein:

said first and second open-close valves each comprises a valve element and an electrostrictive element for opening and closing said valve element;

said rotational speed detection means comprises a rotation speed sensor;

said pressure detection means comprises a pressure detection sensor; and said control means comprises a controller that controls current conduction to said electrostrictive elements in response to the maximum pressure in the cylinder chamber detected by said pressure detection sensor and controls the timing of current conduction to said electrostrictive elements in response to the rotational speed of the cylinder block detected by said rotation sensor.

* * * * *